US005099819A

United States Patent [19]

Simonds et al.

[11] Patent Number: 5,099,819

[45] Date of Patent: Mar. 31, 1992

[54] COMPOUND BOW HAVING TUBULAR RISERS

[75] Inventors: Gary L. Simonds; Thomas P. Jennings, both of Gainesville, Fla.

[73] Assignee: Bear Archery Inc., Gainesville, Fla.

[21] Appl. No.: 416,037

[22] Filed: Oct. 2, 1989

[51] Int. Cl.[5] ..... F41B 5/00

[52] U.S. Cl. ..... 124/23.1; 124/25.6; 124/88

[58] Field of Search ..... 124/23 R, 23 A, 24 R, 124/24 A, 25, 88, 89, 86, DIG. 1, 23.1, 25.6; 285/397

[56] References Cited

U.S. PATENT DOCUMENTS

| | | | |
|---|---|---|---|
| 1,188,485 | 6/1916 | Pruyn | 285/397 |
| 1,810,335 | 6/1931 | Barnhart | 124/23 R |
| 1,853,294 | 4/1932 | Barnhart | 124/23 R |
| 1,877,273 | 9/1932 | Cowdery | 124/23 R |
| 2,000,832 | 5/1935 | Fisher | 124/23 R |
| 2,608,188 | 8/1952 | Howard | 124/88 X |
| 3,055,353 | 9/1962 | Perrucci | 124/24 R |
| 4,124,014 | 11/1978 | Darlington | 124/88 |
| 4,458,657 | 7/1984 | Stockmar | 124/24 R X |
| 4,712,533 | 12/1987 | Cruise | 124/25.6 |

FOREIGN PATENT DOCUMENTS

| | | | |
|---|---|---|---|
| 221885 | 6/1962 | Australia | 285/397 |
| 1196902 | 7/1965 | Fed. Rep. of Germany | 285/397 |

*Primary Examiner*—Randolph A. Reese
*Assistant Examiner*—Jeffrey L. Thompson
*Attorney, Agent, or Firm*—Malina & Wolson

[57] ABSTRACT

An improved compound bow having a rigid lightweight, high strength central portion which connects the opposed inner ends of the bow limbs and includes spaced apart, centrally offset tubular risers. The riser offsetting provides a sight window which extends over the entire space intermediate the limbs. The tubular risers are preferably made of lightweight extruded material to impart strength while maintaining reduced weight and fabrication costs. The riser is affixed to the bow limbs through limb boots and the riser may carry a laterally extending suppport platform. The platform is constructed to rigidly support either a right or left handed grip, a draw cable guard and if desired an arrow rest and a target sight. The components may be of modular construction to permit the compound bow to be readily assembled into a length suitable for a right or left handed individual archer.

23 Claims, 7 Drawing Sheets

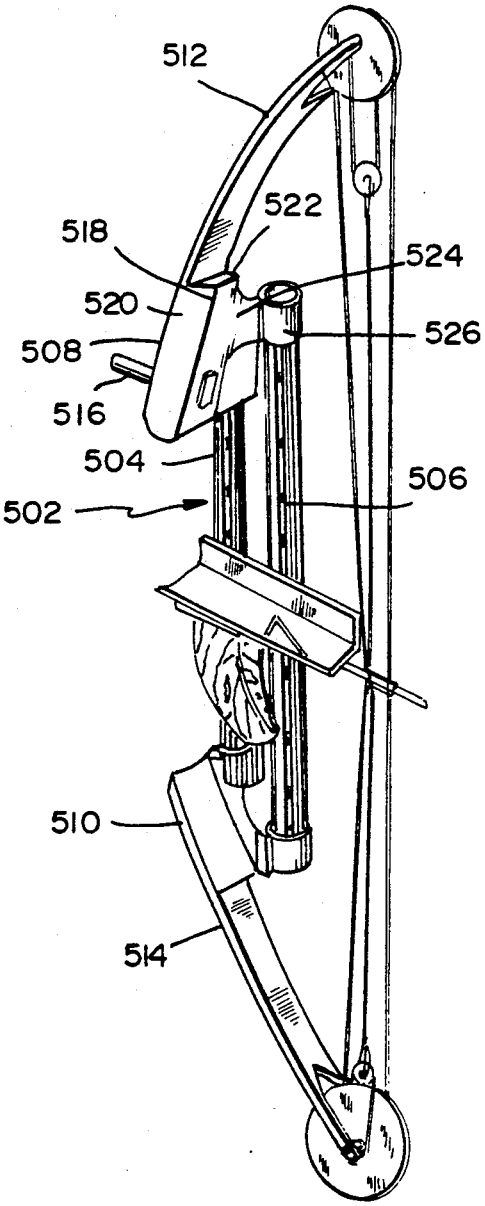
FIG. 8
FIG. 9
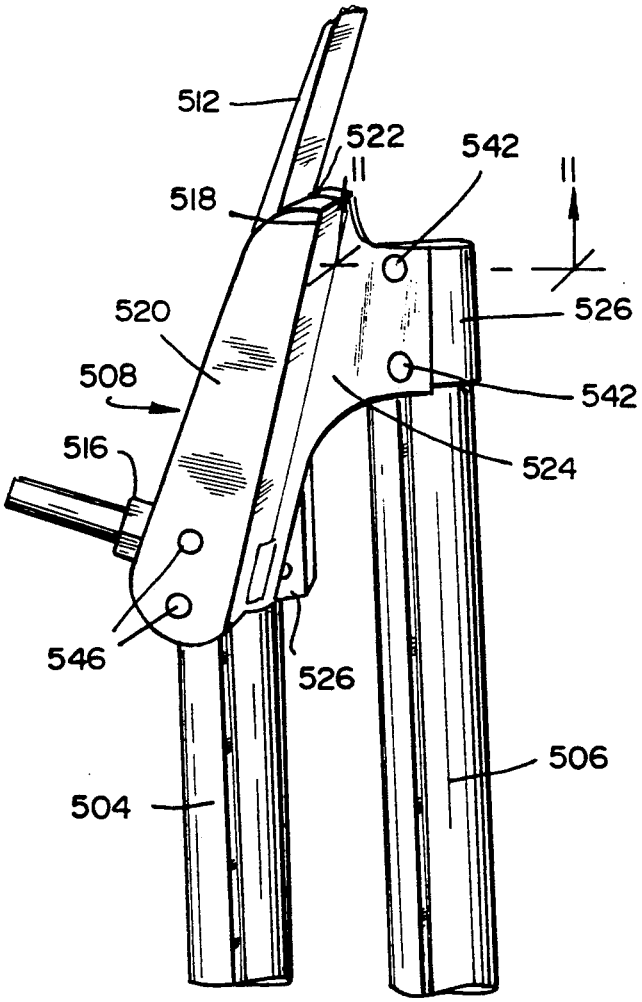

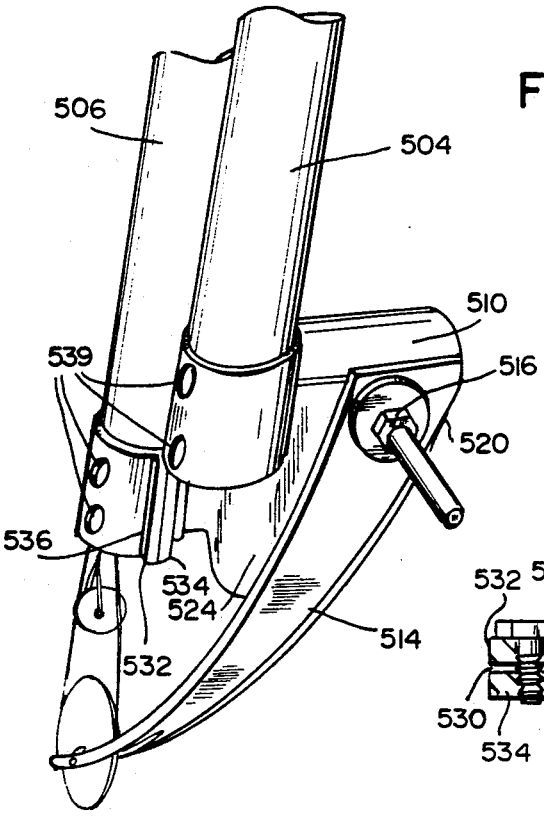
FIG. 10
FIG. 11
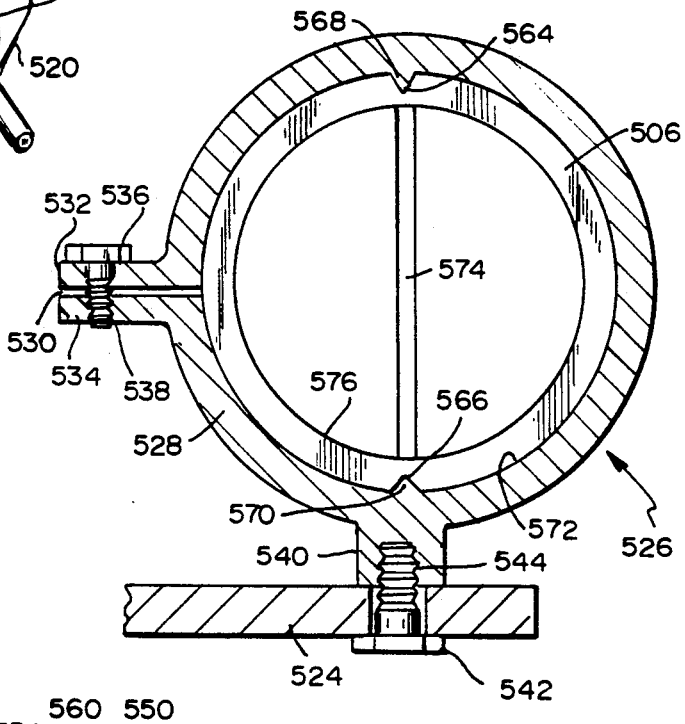
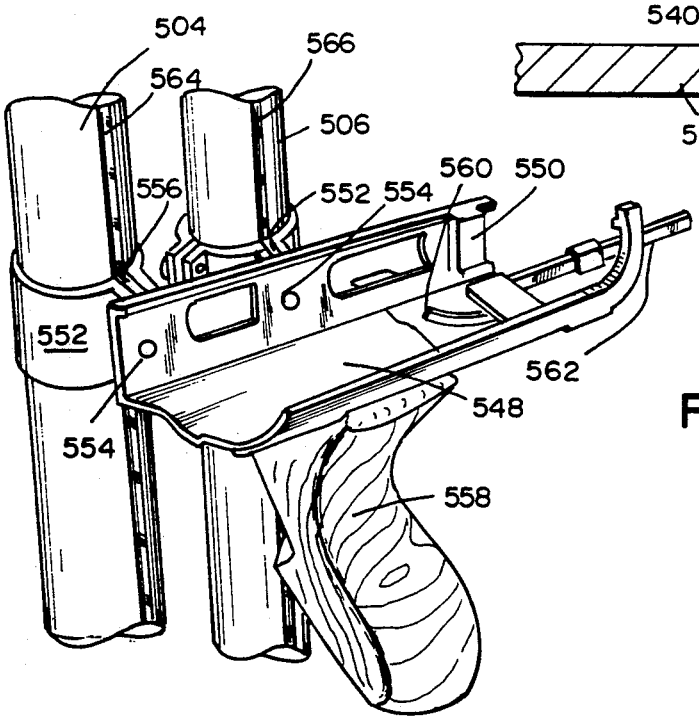
FIG. 12

COMPOUND BOW HAVING TUBULAR RISERS

CROSS-REFERENCES TO RELATED APPLICATIONS

There are no related patent applications.

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

The present invention relates generally to archery equipment and more particularly pertains to improved compound bows.

(2) Description of the Prior Art

Archery bows in their simplest form are of unitary construction and are formed to include a bow handle, upper and lower resilient limb portions extending therefrom, and a bowstring attached to the upper and lower limbs.

In operation, as the archer draws the bowstring, the upper and lower limbs are flexed and potential energy is stored therein. When the archer releases the bowstring, the stored energy in the limbs propels the bowstring and the arrow nocked therein forwardly. The greater the energy required to flex the limbs the greater will be the energy available to propel the arrow when the bowstring is released. Arrow acceleration, arrow speed, the distance the arrow will travel, and the force with which it will strike the target are directly related to the force with which the arrow is initially launched. It is thus desirable to increase the amount of energy stored in the bow limbs so as to increase the force available to propel the arrow. Compound bows, in general, are able to store significantly more energy in their bow limbs than are simple, non-compound bows having long, more flexible limbs. However, the bending moments produced by the relatively widely separated bow limbs of compound bows are large and commonly require larger, more massive cast, forged or machined risers formed with handles or hand grips. Such risers have typically been constructed of lower strength materials such as wood, metallic composites of magnesium, and aluminum, the latter of which were formed by shaping, casting or forging. But because these lower strength materials had to withstand the large bending moments produced by the flexure of the limbs, and since the grip was a portion of the load bearing member, more riser mass was required to achieve the desired strength. An exception was the use of high strength aluminum forgings to produce bow handles, but only limited handle designs could be produced in this manner. Moreover, the fabrication process to produce such forgings was expensive and, in addition to the initial tooling expenses as, for example, to change the length of a bow riser, required extensive additional expense.

Since archery bows, particularly those used for hunting, were required to be both lightweight and portable, the low strength prior art compound bow risers of increased weight had distinct disadvantages. The relatively lightweight, high strength aluminum forged handles, capable of operating at higher stress levels, on the other hand, were not commercially practical. In addition, because the physical characteristics of the materials constituting bow riser components could not be accurately predicted, the components were over designed to assure adequate strength and to compensate for inherent design inaccuracies. That over design, however, resulted in heavier bows and attendant increased manufacturing costs.

Other types of lighter weight compound bow risers are disclosed in U.S. Pat. Nos. 4,756,295 and 4,759,337. The riser of the '295 patent is a single sturdy strap bent to either side or two straps secured together at the top and bottom and bowed apart at the center. The riser is connected to the limbs through a pivot point by a bolt. The riser of the '337 patent includes upper and lower sight windows 22 and 24 which are defined by upwardly and downwardly converging thin plate walls. Both of these risers differ significantly from the tubular structure of the instant invention in structure and the manner of producing the risers. In addition to the foregoing, U.S. Pat. Nos. 4,457,287, 3,055,353 and 4,124,014 show adjustable hand grips. These patents do not disclose or suggest the combination of a tubular riser assembly and an adjustable hand grip.

There are also known simple bows which were constructed of separable elements wherein the limbs were connected by tubular handles or couplers. See, for example, the tubular couplers disclosed in the simple non-compound bows disclosed in U.S. Pat. Nos. 2,608,188, 2,000,832, 1,877,273, 1,853,294 and 3,566,853. The tubular couplers disclosed therein join relatively flexible limbs in abutting relationship at their free ends. Since the limbs are highly flexible and the separation, if any, between the limb ends is small, the bending forces imposed on the tubular coupler are minimal. For this reason, the simple non-compound bow tubular couplers were able to be formed of thin walled, low strength materials. However, the tubular couplers of the simple non-compound bows were never required to withstand the large bending forces such as produced when the limbs of a compound bow are flexed, and tubular couplers were never used in compound bows. The single tubular riser 10 of the recurvature bow disclosed in the '853 patent is formed with an apex 13 so as to be generally "V" shaped. Such a shaped riser is less resistant to the bending forces and for that reason would be unsuitable for use with a compound bow having relatively stiff limbs. The foregoing structural differences patentably distinguish this cited patent from the instant invention.

SUMMARY OF THE INVENTION

The general purpose of the instant invention is to provide a riser assembly for a compound bow that has all the advantages of similarly employed prior art bows and has none of the disadvantages. The present invention comprises a compound bow including tubular risers formed of lightweight, high strength material disposed between and offset from the inner ends of the bow limbs. The risers are offset from the center line of the limbs and the bowstring to provide an elongated sight window through which an arrow can readily pass and to provide a clear full field of view for the archer. A support platform may be carried by the risers and may be located intermediate the ends of the risers. The support platform may be positioned to extend laterally across the sight window.

A bow hand grip may be supported by the platform for selective positioning along the path of the arrow and bowstring movement. Additionally, the platform may support a cable guard rod and if desired both a target sight and an arrow rest. The latter three components can also be directly affixed to either or both risers. Additionally, the risers and other components of the present invention may be of modular construction enabling interchangeable components to be used in the bow so that, for example, the length of the risers most appropriate for a particular archer may readily be selected for incorporation into the bow.

Further, the present invention comprises a compound archery bow riser which is formed of a lightweight, extruded metal, such as aluminum, or extruded composite materials containing high strength fibers such as graphite, carbon and the like, all such materials having a high strength to weight ratio. The high strength to weight ratio enables the bow risers of the present invention to be of significantly less weight, but of equal or greater strength than prior art compound bows. The compound tubular bow risers of the present invention are particularly effective in resisting the bending moments produced by bow limbs. Moreover, as the physical characteristics of the extruded bow riser are significantly more predictable than the physical characteristics of prior art devices the riser need not be overdesigned and it is possible to achieve a more efficiently designed, lighter weight, and less costly bow in accordance with the present invention.

The tubular risers of the present invention can be extruded in a wide variety of cross-sectional shapes and designs. Moreover, the cost of producing bow risers by an extrusion process compares favorably with the cost of producing them by any of the prior art processes.

Accordingly, it is an object of this invention to provide an improved compound bow employing a riser assembly which is lightweight, of high strength and inexpensive to manufacture, and adaptable for modular construction.

Another object of the instant invention is to provide an improved compound bow which includes a riser assembly for supporting a separate adjustable hand grip suitable for either right or left handed archers and on which other archery components may be supported.

Other objects and many of the attendant advantages of this invention will be readily appreciated as the same becomes better understood by reference to the following detail description when considered in connection with the accompanying drawings in which like reference numerals designate like parts throughout the figures thereof.

BRIEF DESCRIPTION OF THE DRAWINGS

FIG. 8 is a perspective side elevation view of yet another embodiment made in accordance with the present invention;

FIG. 9 is a perspective view of the embodiment of FIG. 8 showing the limb boot and the riser attachment thereto;

FIG. 10 is another perspective view of the embodiment of FIG. 8 showing the limb boot and the riser attachment thereto;

FIG. 11 shows a section of the embodiment taken along line 11—11 of FIG. 9 viewed in the direction of the arrows;

FIG. 12 is a perspective view showing the platform assembly and its attachment to the risers;

DETAILED DESCRIPTION OF THE PREFERRED EMBODIMENT

Figure 1:
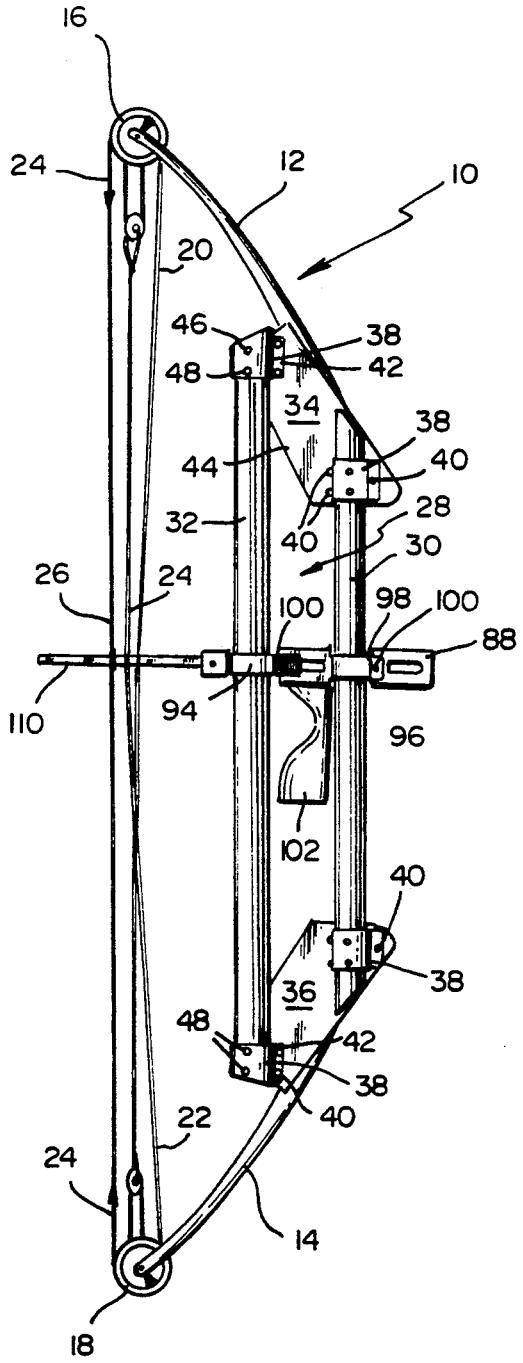
FIG. 1 is a first side elevation view of an embodiment of the compound bow constructed in accordance with the present invention.

In the illustrated embodiment of FIG. 1 a compound bow generally designated at 10 includes a pair of opposed limbs 12, 14 which carry centrally disposed eccentric pulleys 16, 18 at their outer ends over which pass segments 20, 22 of anchor cable and draw cable 24. Opposed limbs 12, 14 are shortened and relatively stiff. Bowstring 26 is connected between the free ends of draw cable 24. The principle of the instant invention and the attendant structural elements may generally be applied to compound bows which themselves are well known, fully disclosed and described in the prior art.

The riser assembly 28 includes a pair of spaced apart tubular risers 30 and 32 which may be fabricated by extrusion of any suitable lightweight and high strength material such as aluminum, alloys thereof, titanium, magnesium, composites containing high strength reinforced fibers such as glass, graphite, carbon, kelvar, etc. The latter materials can be pultruded, filament wound or layed-up. The assembly carries a pair of oppositely disposed limb boots 34, 36 which are releasably coupled to the risers 30, 32 by peripherally engaging clamps 38 each of which is affixed to the limb boot by bolts 40 that pass through openings in the clamp flanges 42 and thread into aligned mating holes in the boot wall 44 to thus provide tight frictional engagement between the riser and the clamp to position and retain the boots. The clamp flanges could equally well be threaded to accept bolts passing through the boot wall. Since the riser assembly 28 is subjected to high bending moments and torsional forces, the engaging clamps 38 are formed with openings 46 through which pass securing bolts 48 that thread into mating holes in the riser so that the clamp is effectively bolted to both the boot and the riser. Other methods of attachment are described with reference to subsequently illustrated embodiments.

A limb boot essentially serves as a link or connection between the bow limb and the riser and cradles the limb intermediate its upstanding side walls for attachment of the limb to the riser end.

Figure 2:
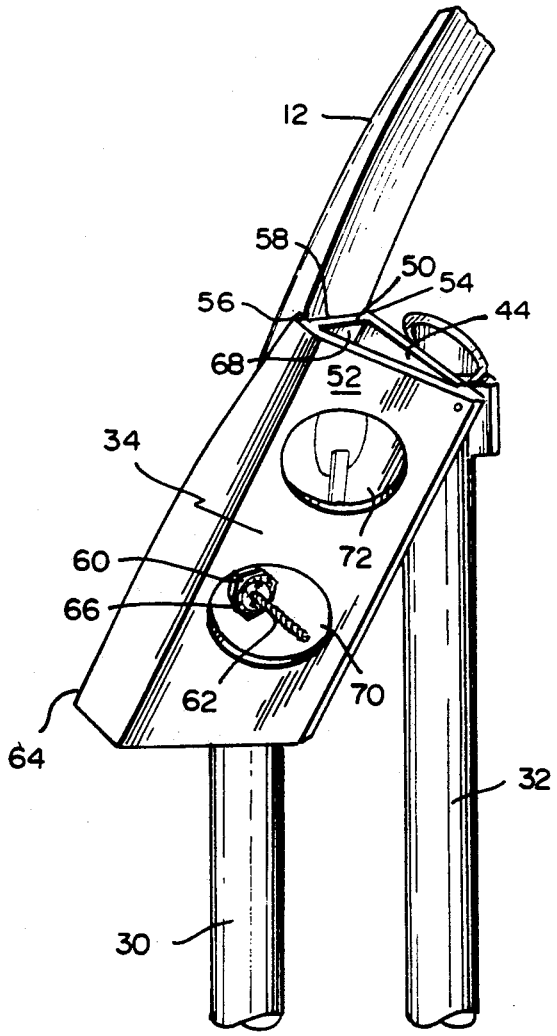
FIG. 2 is a perspective view of the embodiment of FIG. 1 showing the limb, limb boot and riser interconnections.

Referring now to FIG. 2 which shows the structure of the limb boot 34 which can be of any lightweight material of sufficient strength, such as aluminum. Boot 34 as well as boot 36 are elongated members formed by three intersecting and joined plate-like walls 44, 50 and 52. The juncture of the walls in cross-section defines a right triangle with wall 44 extending beyond its intersection with wall 50 to provide a first upstanding wall portion 54. The opposite wall member 52 provides a second upstanding wall portion 56 opposed to and spaced from the first wall portion 54 to thereby, in conjunction with the wall member 50, form an extending channel 58 therebetween for receiving bow limb 12. The same structural arrangement pertains to limb 14 except that it is received in the channel provided by boot 36. The upstanding wall portions converge outwardly to confine the limb's lateral movement. The limb is physically attached to the boot by a draw weight adjusting bolt assembly 60 which may include a washer and a bolt 62 which passes through the bow limb 12 proximate its inner end 64. The bolt 62 is threaded into a fixed mating nut member 66 disposed on the face 68 of wall member 50 opposite limb 12. Wall 52 is formed with a pair of openings 70, 72 to allow easy access to nut 66 and bolt 62. Lateral movement of bolt 62 permits limited pivotal movement of the limbs to vary the bow draw weight over a percentage of its overall limits. The cross-sectional dimensions and shape of the boots may, of course, be varied so as to provide the necessary physical characteristics, esthetics and the strength required.

Figure 3:
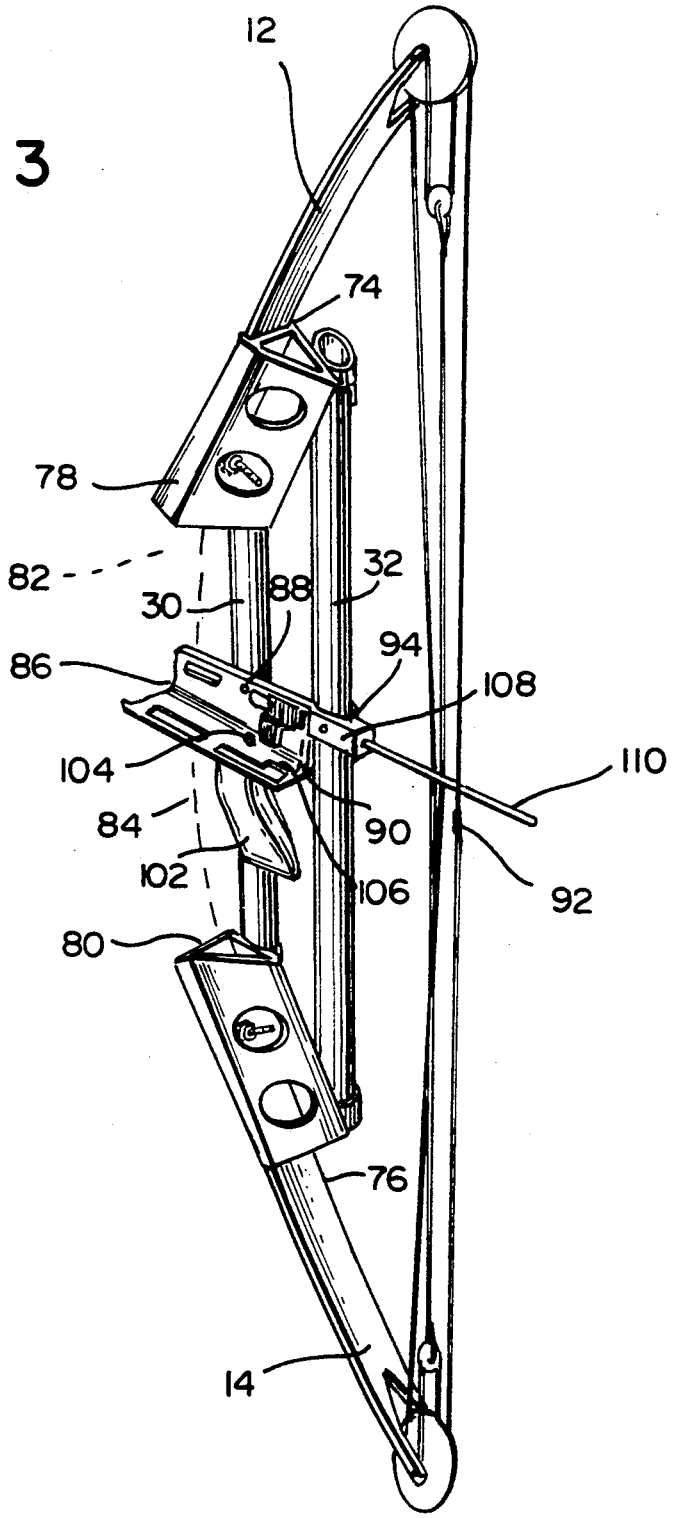
FIG. 3 is a second side elevation view of the compound bow constructed in accordance with the present invention.

Reference is now to FIG. 3 in conjunction with FIG. 1. Since the risers are disposed along one outer side edge 74, 76 of the limbs 12, 14 or the limb boots 34, 36, they are effectively offset from the bow centerline 84. The area between the inner ends 78, 80 of the limbs defines an open bow sight window 82. This window area provides the archer with an unobstructed view of the target.

An "L" shaped platform assembly 86 is supported by and intermediate the ends of the risers 30, 32. Arm 88 of platform assembly 86 abuts the risers 30, 32. The arm 90 of platform assembly 86 extends laterally from the risers 30, 32 into and across the bow centerline 84 and sight window area 82. The platform is positioned so that its upper surface is aligned approximately with the midpoint between the ends of risers 30, 32. This positions the push point of the handle slightly below the centerline. The horizontal location of platform assembly 86 is adjustable during manufacture and its position on risers 30 and 32 can be varied vertically to suit design configurations. The platform assembly 86 is affixed to the risers 30, 32 by circumferential clamps 94, 96 (FIG. 1) that are bolted to the arm 88 via clamp flanges 98 and bolts 100. A hand grip 102 is secured by the bottom of the platform assembly 86 so as to be in alignment (or as near alignment as desired while balancing the torsional moments) with the path of an arrow as well as the bow centerline. The grip is secured to the platform arm 90 by screws 104 which extend through one of the lengthwise extending slots 106 or a series of mounting holes on platform arm 90, and thread into the mating upper abutting surface of the hand grip 102. This arrangement permits adjustment of the hand grip 102 lengthwise to vary the overall draw length. In this and the other embodiments of the invention, the hand grip 102 is secured to the platform and therefore is not subjected to the same bending moment exerted by the limbs 12 and 14. For this reason the design of the hand grip 102 is not limited and it can be fabricated of relatively lightweight materials such as magnesium, wood, plastics and composites. Further, since the platform assembly 86 is centrally positioned the hand grip 102 can be mounted to accommodate either a right or left handed archer.

The platform assembly 86 can also carry arrow rest 108 while one or both of the risers can carry a target or hunting sight assembly (not shown). In addition, the platform and/or the risers can support a rearwardly extending cable guard rod 110 or other cable deflecting means.

It is clear from the foregoing description that although the cross-sectional shape of the illustrated risers is circular, other configurations including the wall thickness of the tubular riser may be selected to provide the physical characteristics desired for any particular bow arrangement. Further, since the riser assembly is releasably affixed, the assembly is of modular construction and may be modified by merely substituting different length risers to vary the separation between the limbs and thus accommodate the preferences of the archer or bow manufacturer.

Figure 4:
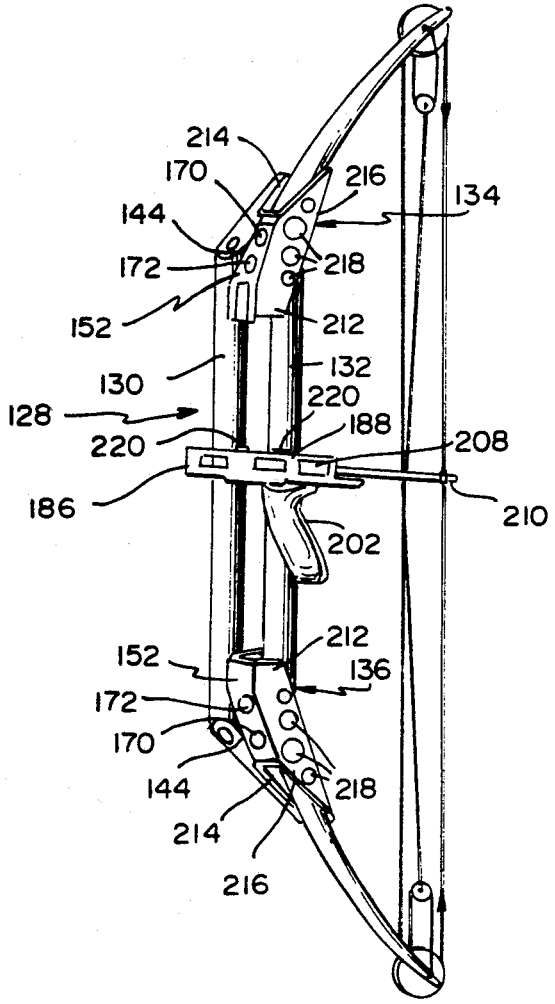
FIG. 4 is a perspective side elevation view of another embodiment made in accordance with the present invention.

The embodiment of the invention shown in FIG. 4 is similar to the embodiment of FIG. 1. In view of the similarity, a description of those elements common to both embodiments will not be repeated. This embodiment illustrates an alternate method for attaching the risers to the limb boots. The riser assembly 128 includes a pair of spaced apart risers 130, 132 similar to risers 30, 32 of FIG. 1 except these risers are peripherally welded to one side wall 144 of each of the limb boots 134, 136. Weld joints provide a high strength and low cost method of attachment. The limb boots 134, 136 are generally rectangular in cross-section at their inner ends with their outer side walls 214, 216 converging outwardly past the inner end to form a channel in which the limb is received. As previously described, the bow limb may be attached to the boot by way of a bolt assembly, access to which is gained through opening 170, 172 in the outer wall 152 of the boot. In order to reduce the weight of the boot it is formed with a plurality of openings 218 in its outer walls.

Although not a desirable means of attachment, a generally "L" shaped platform assembly 186 may be mounted on risers 130, 132 by spot welding the shorter arm 188 at 220 to the risers. The platform itself is similar to that of FIG. 1 and similarly carries a hand grip 202, an arrow rest 208 and a cable guard rod 210. The hand grip 202 is adjustable lengthwise along the platform in the same manner as is the hand grip 102 of the first embodiment.

Figure 5:
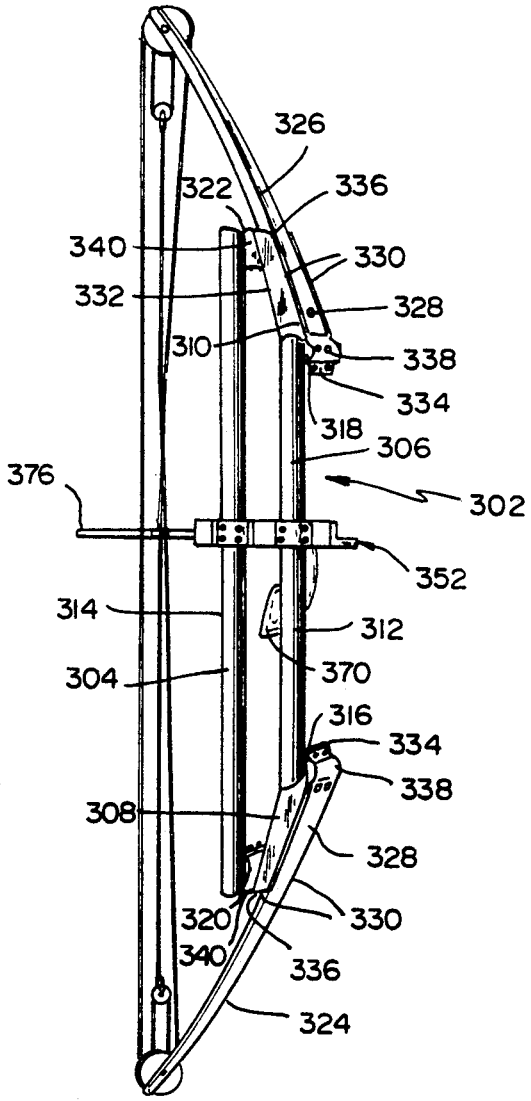
FIG. 5 is a perspective side elevation view of a still further embodiment made in accordance with the present invention.

In the illustrated embodiment of FIG. 5 the overall bow structure is similar to those shown in the previously described drawings except for the limb boots, the risers and their method of attachment to one another. The riser assembly 302 includes a pair of "U" shaped risers 304, 306 releasably mounted to the limb boots 308, 310. The risers are tubular in cross-section and are each formed with a center vertical section 312, 314 and at each end thereof with laterally extending short legs 316, 318, 320 and 322. These short legs may be formed by bending a single tube or can be joined by welding. Although, as shown, the legs extend from the center vertical section perpendicularly, legs extending therefrom at other angular displacements can be employed. As previously shown the risers are of different lengths, namely, a longer riser 304 affixed between the outer ends of the boots and a shorter riser 306 joining the inner boot ends. These laterally extending legs serve to offset the riser vertical sections 312, 314 sideways from the bow limbs 324, 326 when the legs are coupled to the limb boots.

Figure 6:
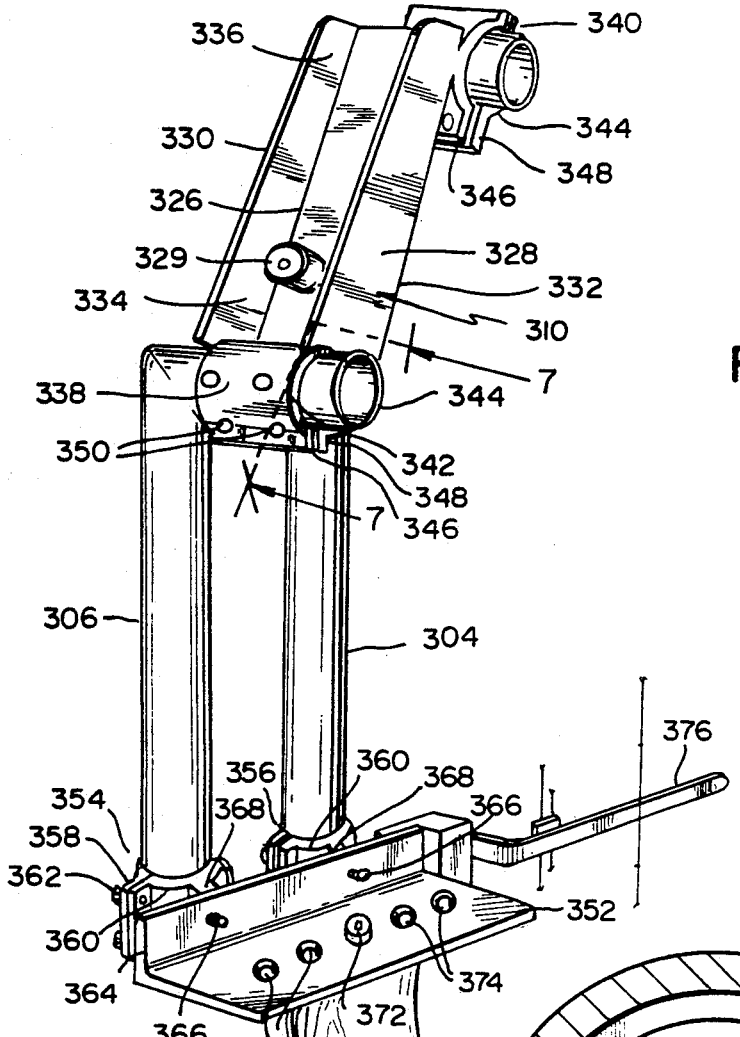
FIG. 6 is an exploded perspective view of the bow platform and the attachment of the risers to the limb boot of the embodiment shown in FIG. 5.

Referring now also to FIG. 6 in which the limb boot 310 is formed with two upstanding wall portions 328, 330 joined together by a base 332 to thereby provide a channel there-between for receiving the bow limbs 324, 326. The bow limbs are physically affixed to the limb boot by adjusting bolt assembly 329 which passes through the bow limb near its inner end and is threaded into the boot base wall 332. Adjusting boot limb assemblies are well known in the art. Upstanding boot walls 328, 330 both converge outwardly of the bow center toward the base wall 332 so that the boot channel for receiving the limb is deeper at the inner boot end 334 than at the outer end 336.

Each limb boot carries a pair of riser attaching assemblies 338, 340 one at the inner boot end and the other near the outer end. The attaching assemblies each include a pair of opposed semi-circular pipe type clamp members 342, 344 each of which are formed with two opposed flanges 346, 348. When the assembly is employed, the inner surfaces of the flanges abut and the clamp members are releasably joined by bolts 350 to provide a tubular channel therebetween in which the riser legs are frictionally secured. The clamp members extend across the width of the limb boot with one such member fixed to the boot base wall 332 by any suitable means sufficient to withstand the forces imposed when the bow limbs are flexed. Such means can include welding or forming one of the clamp members with a longitudinal radially extending abutment to which the base wall is bolted.

The risers 304, 306 adjustably carry an "L" shaped platform 352 for displacement in a vertical direction intermediate their ends. The platform is attached to the risers by clamp assemblies 354, 356 which are similar in structure to the clamp assemblies described heretofore and include clamp members 358, 360 joined by bolts 362 encircling the risers and frictionally supporting the platform. The upwardly directed wall 364 of the platform is secured to each of the clamp members by screw 366 which is threaded into the abutment 368 of the clamp member 360.

A hand grip 370 is secured below the platform by recessed screw fastener 372 that extends through one of the countersunk openings 374 and is threaded into the upper hand grip surface. Thus, the hand grip 370 may be selectively positioned lengthwise of the platform to vary the draw length. The platform can also mount a cable guard rod 376 as well as other archery bow accessories and components.

Figure 7:
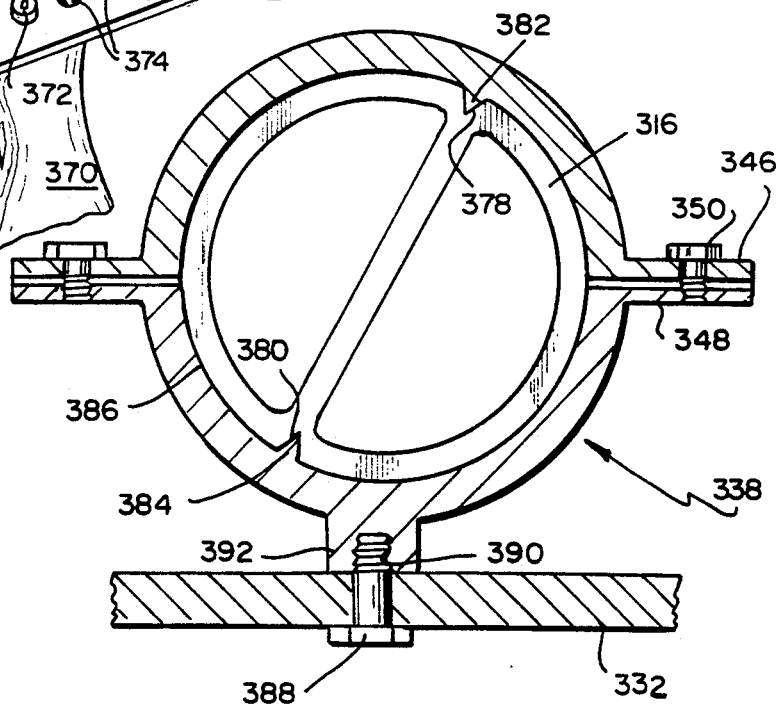
FIG. 7 shows a section of the embodiment taken along line 7—7 of FIG. 6 viewed in the direction of the arrows.

From the foregoing, it is clear that the risers can be attached to the boots through frictional engagement with the clamp members. Since the bending moment, load and torque are transferred from the limb boots to the risers through the clamps the coupling structure must be capable of transmitting such forces without slipping or generating noise (when hunting). Although the described structure has been found adequate for the purpose, an additional margin of reliability can be achieved. To this end, there is shown in FIG. 7 a sectional view of a locking means forming part of each clamp assembly as in one of the riser clamp/boot assemblies 338 wherein the tubular leg 316 of the riser is formed on its outer surface with a pair of longitudinally extending radially opposed "V" shaped grooves 378, 380 which receive mating "V" shaped teeth 382, 384 formed integral with and on the inner face 386 of each of the clamp members 358, 360. It should be noted that the locking means can take a variety of forms other than that described and yet constitute a part of this invention. The clamp assembly 338 for example, is rigidly affixed to the boot base wall 332 by a number of lengthwise disposed bolts 388 which pass through the wall and are threaded into the openings 390 in abutment 392 formed into the clamp member.

An angular displacement between the limb boot and the risers is present for improved bow operation and therefore the engaging "V" sections are designed to be in selected relative positions whereby when the riser leg is set into the clamp for locking engagement the proper angular displacement is achieved.

In the illustrated embodiment of FIG. 8 the overall bow structure is also similar to those of the previously described embodiments. The riser assembly 502 includes a pair of tubular risers 504, 506 releasably mounted to the limb boots 508, 510. The risers are straight tubular structures and extend vertically between the bow limbs 512, 514. As also shown in FIG. 9 the bow limb 512 is affixed to limb boot 508 by the adjusting bolt assembly 516 which extends through the limb and the base 518 of the boot 508 and is seated in the channel formed between the spaced apart sidewalls 520, 522 of the boot 508. Sidewall 522 projects below the base 518 and is formed with a tubular extension 524 so as to provide a lateral separation between the opposite ends of the boot sidewall 522.

The tubular risers 504, 506 are releasably affixed, in spaced apart relation, to the extension 524 and to the opposite end of sidewall 522 by split clamps 526. The split clamps 526, as best illustrated in FIGS. 10 and 11 include a tubular wall 528 which encircles the riser 506 and is split along 530. Extending lengthwise along split 530 the clamp is formed with a pair of opposed flanges 532, 534 that are joined together by any suitable means, for example, by a bolt or screw 536 which passes through flange 532 and is threaded into an opening 538 in flange 534. Each clamp may be formed, if necessary, with a pair of openings 539 through its wall to thereby permit the clamp to compress or bend inwardly. The inner diameter of the split clamp 526 is just slightly smaller than the outer diameter of the riser so that as the clamp is tightened by bolts 536 the inner surface of the clamp compresses around the riser to retain and hold the riser. Additionally, the split clamps 526 are formed with an abutment 540 and are rigidly attached to the limb boot sidewall by a number of lengthwise disposed bolts 542 which pass through the sidewall and are threaded into openings 544 in the abutment 540. Opposed sidewall 520 as shown in FIG. 9 is provided with a pair of openings 546 aligned with the openings 544 in which the bolts 542 are seated to permit threading the bolts 542 into the clamp 526 that affixes riser 504.

Referring now to FIG. 12 wherein the risers 504, 506 releasably carry a platform 548 which is adjustable vertically between the ends of the risers. The platform is semi-cylindrical and has an upwardly extending vertical wall 550. The platform is attached to the risers by split clamps 552 similar to those clamps which affix the risers to their respective limb boots and is attached to the clamps by screws 554 which are threaded into abutment 556 of the clamp 552.

A hand grip 558 is secured to and below the platform by any suitable means such as screws passing through the platform and threaded into the hand grip or those previously described with respect to the other illustrated embodiments of this invention. The upper surface of the hand grip is contoured to smoothly abut the lower cylindrical surface of the platform 548 and to permit selective lengthwise positioning of the hand grip to vary the draw length. The platform and the grip may be keyed in their mating surface to better resist torque forces. The platform can also mount an arrow rest support 560 as well as a cable guard rod 562 and other accessories.

The risers are formed on their outer surface with a pair of opposed longitudinally extending "V" shaped grooves 564, 566 which receive mating "V" shaped teeth 568, 570 formed integral with the inner surface 572 of the split clamp 526 to define one form of a locking means. Additionally, in order to strengthen and compensate for the possible weakening of the riser wall by the "V" groove, or to selectively strengthen the riser to resist transverse bending, the riser is provided with a longitudinally extending stiffener wall 574 disposed on the inner surface 576 extending between the opposed "V" grooves.

Additionally, the methods of attaching the various components together can take forms other than those previously described. For example, the attaching means could include adhesives. Suitable adhesives for the purposes include epoxies, urethanes and anaerobics. Where it is found that more positive locking means are necessary, the joined components can be keyed together to better withstand high torque forces. The riser/clamp junction and the screw attachment of the hand grip to the support each also include mating keyed surfaces.

Figure 13:
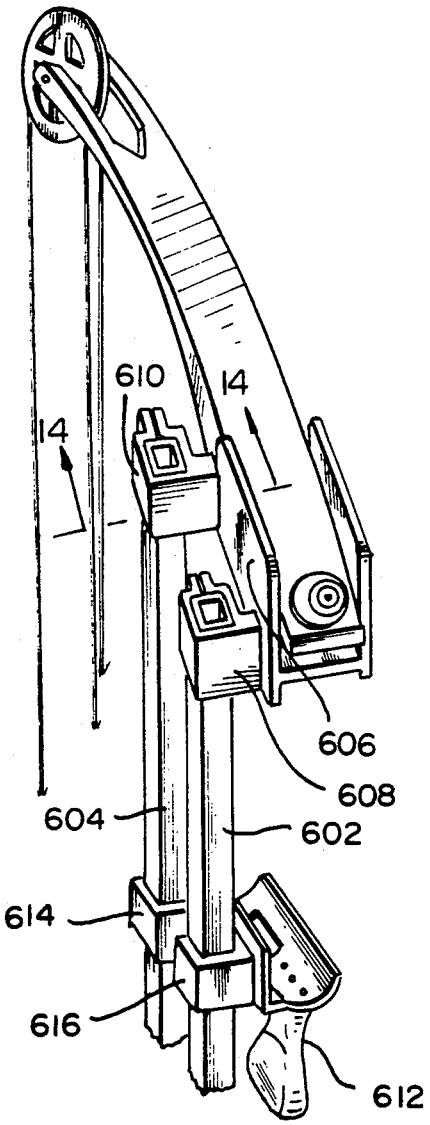
FIG. 13 is a perspective view of still another embodiment made in accordance with the present invention wherein the risers are not circular in cross-section.

In the foregoing embodiments the tubular risers have been shown as circular in cross section. Risers of different non-circular, cross sectional configurations, for example, oval, rectangular, square, multi-sided, and irregular, are also suitable. Of course, it is understood that the components that mate with or are fitted to the non-circular risers such as the clamps would be contoured to conform to the riser configuration. FIG. 13 illustrates a pair of risers 602 and 604 having rectangular or square cross-sections mounted to one limb boot sidewall 606 by rectangular split clamps 608 and 610. These clamps 608 and 610 are affixed to the limb boot sidewall by any suitable means such as bolts. Similarly the hand grip 612 can be supported by split clamps 614 and 616 carried by risers 602 and 604.

Figure 14:
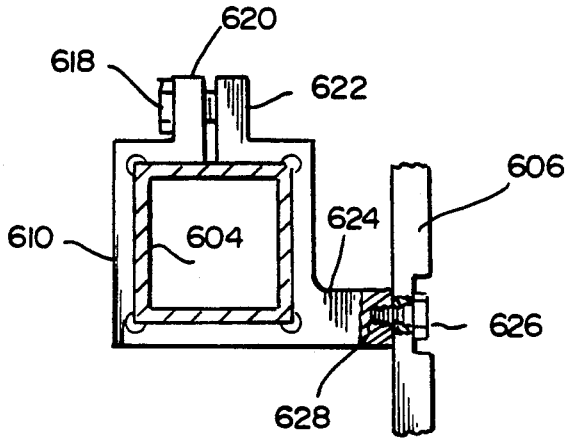
FIG. 14 shows a section of the embodiment taken along line 14—14 of FIG. 13 viewed in the direction of the arrows.

Referring now to FIG. 14 wherein the split clamp 610 surrounds and firmly holds therein the rectangular riser 604, by the clamping action of bolt 618 which passes through the flange 620 and is threaded into the opposing flange 622. Extension 624 is affixed to limb boot sidewall 606 by bolt 626 which is countersunk into the boot sidewall 606, and threaded into an aligned opening 628 in extension 624 to thereby securely fasten the riser 604 to the boot sidewall 606.

Figure 15:
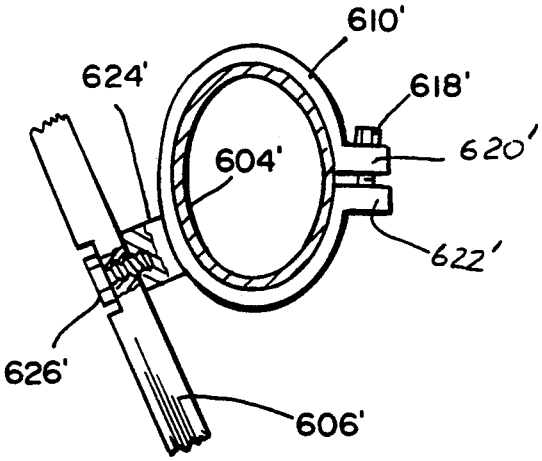
FIG. 15 is a cross-sectional view similar to FIG. 14 wherein the riser is oval in cross-section.

Similarly as shown in FIG. 15, a riser 604' of oval cross-section is tightly confined in oval split clamp 610' by the clamping action of bolt 618' which passes through flange 620' and is threaded into the opposing flange 622'. The clamp extension 624' is secured to the limb boot sidewall 606' by recessed bolt 626'.

Significant advantages and benefits are derived for all the foregoing embodiments because the risers, and not the hand grip, are subjected to the major bending loads produced when the bow limbs are flexed.

Since the hand grip can be attached to the risers and only has to carry the maximum draw weight of the bow, the method of attachment can be such as to permit adjustment both fore and aft in the plane of arrow flight as well as in the vertical plane. The fore and aft adjustment permits the archer to exercise some degree of control over the power stroke attainable for a given bow setup which includes the combination of limbs, eccentric cams and cable rigging. For example, when the hand grip is moved forward of its central position, the effective draw length is increased without altering the power stroke. The effective draw length is shortened when the hand grip is moved rearward while retaining the same power stroke. The ability to adjust the hand grip position fore and aft in the horizontal plane can allow the archer to control string height over a range of several inches without any change in the peak bow weight or let-off. Additionally, it permits the archer to increase or decrease the power stroke for a given draw length to thereby change arrow velocity and overall bow performance.

Vertical adjustment of the hand grip with respect to the center line between the eccentric compounding units permits the archer to individually set the grip for his own shooting characteristics. In the prior art bow handle designs, the manufacturer fixed the center of pressure or the point at which force was applied by the archer to the hand grip. These designs have also varied the center of pressure as much as one inch from the geometric center of the bow. Where it is desired to increase the length of the sight window (space between the arrow rest and the upper limb boot) in order to accommodate a shorter range sight pin, the hand grip can be moved below the center line. In addition, vertical adjustment of the hand grip may compensate for the imbalance imposed on the bow system by a "string walking" (shooting technique) archer who draws the bowstring at a point other than where the arrow is positioned. It is possible that vertical adjustment of the hand grip would achieve better balance and sighting for such an archer.

With the hand grip no longer a major load bearing member, its size, shape and composition may be greatly varied. For example, wood, plastic or metal would be suitable materials. Further, the grip may be designed with a very small cross section at the throat of the grip to thereby reduce the torque of the bow about the vertical axis. It is also known that a small throat cross section can improve shooting accuracy by reducing the lateral arrow spread.

The offset riser design provides an unobstructed sight window and permits the arrow to be supported at or as near the bow vertical centerline as desired to achieve good flight characteristics without encountering any interference with the arrow fletch or large hunting arrowheads.

A popular feature in archery at this time is the utilization of overdraw arrow rest combined with low brace height. Overdraw occurs when the arrow is drawn beyond the point where the bow hand applies pressure to the bow grip (pivot point). The brace height is the distance between the bow string and the hand grip pivot point (i.e. the point on the hand grip engaged by the archer's hand) when the bow is not drawn. Generally the shorter the brace height the greater will be the the energy it can store for a given draw length. The longer the draw length the greater will be the energy imparted to the arrow. Variations of these parameters permit maximizing the power stroke. The ability to position the bow hand grip fore and aft provides selective variation in both overdraw and brace height. The offset risers of the present invention provide ample room for a wide variety of overdraw designs and brace heights based on the hand grip location.

Obviously many modifications and variations of the present invention are possible in the light of the above teachings. It is therefore to be understood that, within the scope of the appended claims, the invention may be practiced otherwise than specifically described.

Having thus described the invention, what is claimed as novel and desired to secure by Letters Patent is:

1. An improved archery bow having a pair of relatively stiff limbs extending outwardly in opposite coplanar directions and terminating at their outer ends in limb tip means, said limbs having their inner ends spaced apart from each other, a bowstring intermediate said tip means, a bow centerline defined by said bowstring and the vertical center of said limbs, and a tubular riser assembly comprising at least two spaced apart, side by side tubular members connected between the inner ends of said limbs.

2. The improved archery bow according to claim 1 wherein said bow is a compound bow and said tubular members are straight and linear.

3. The improved archery bow according to claim 1 wherein the cross-sectional shape of said tubular members is circular.

4. The improved archery bow according to claim 1 wherein said tubular members are formed of extruded materials.

5. The improved archery blow according to claim 1 wherein said tubular members are formed of aluminum, alloys thereof, composites containing graphite, carbon, glass or kelvar.

6. The improved archery bow according to claim 1 further including support means carried by said riser assembly.

7. The improved archery bow according to claim 6 further including a bow hand grip carried by said support means.

8. The improved archery bow according to claim 6 further including means for attaching said bow hand grip to said support wherein said means for attaching include screw members threaded into mating opening in said hand grip and keyed therewith whereby movement of said hand grip under torque forces is minimized.

9. The improved archery bow according to claim 1 wherein the cross sectional shape of said tubular members is non-circular.

10. The improved archery blow according to claim 1 wherein the tubular members are releasably connected between the inner ends of the limbs.

11. An improved archery bow having a pair of relatively stiff limbs extending outwardly in opposite coplanar directions and terminating at their outer ends in limb tip means, said limbs having their inner ends spaced apart from each other, a bowstring intermediate said tip means, a bow centerline defined by said bowstring and the vertical center of said limbs, and a tubular riser assembly comprising at least two spaced apart, side by side tubular members connected between the inner ends of said limbs, and wherein said riser assembly is offset from said bow centerline to provide a bowsight window.

12. The improved archery bow according to claim 11 further including limb boots carried by said riser assembly at its ends for coupling said riser assembly to said limbs.

13. The improved archery bow according to claim 12 wherein said limb boot are formed with a channel having a pair of opposed upstanding side walls joined by a base for receiving said limbs and said riser assembly is affixed to one of said sidewalls whereby said riser assembly is offset from said centerline to provide the bow sight window.

14. The improved archery blow according to claim 13 wherein said riser assembly is welded to one of said sidewalls of each limb boot.

15. The improved archery bow according to claim 13 wherein said riser assembly is clamped to one of said sidewalls.

16. The improved archery blow according to claim ***** wherein said tubular members are formed with a center section having a pair of leg portions extending laterally from the ends thereof in coplanar relationship and wherein said limb boots include tubular coupling means for providing locking engagement with said leg portions of said tubular members to thereby offset said center section from said centerline.

17. The improved bow according to claim 12 wherein said support means is a platform extending laterally from said riser assembly into said bowsight window.

18. The improved archery bow according to claim 12 wherein said coupling means includes clamps having their engaging surfaces formed with an extending abutment for mating with a recess formed in the outer face of said leg portions for providing locking engagement therebetween.

19. The improved archery bow according to claim 18 wherein said extending abutment and said recess are V-shaped.

20. The improved archery bow according to claim 12 further including coupling means for attaching said riser assembly and said limb boots.

21. The improved archery bow according to claim 20 wherein said coupling means includes an adhesive.

22. The improved archery bow according to claim 20 wherein said coupling means includes clamp means encircling each of said tubular members and threaded screw means joining said clamp means and said limb boots.

23. The improved archery bow according to claim 22 wherein one of said clamp means and said tubular members are formed with an extending abutment for mating with a recess formed in the other of said clamp means and said tubular members for providing locking engagement therebetween.

* * * * *